US006871710B1

(12) United States Patent
Darling et al.

(10) Patent No.: US 6,871,710 B1
(45) Date of Patent: Mar. 29, 2005

(54) ROTATIONAL FLOAT FOR ROTATING EQUIPMENT

(75) Inventors: W. Brian Darling, Parkville, MO (US); Harlan H. Henke, St. Joseph, MO (US)

(73) Assignee: Altec Industries, Inc., Birmingham, AL (US)

( * ) Notice: Subject to any disclaimer, the term of this patent is extended or adjusted under 35 U.S.C. 154(b) by 33 days.

(21) Appl. No.: 09/846,979

(22) Filed: May 1, 2001

(51) Int. Cl.[7] ..... E21B 7/02

(52) U.S. Cl. ..... 173/184; 173/2; 173/19; 173/42; 173/44

(58) Field of Search ..... 173/184, 44, 43, 173/192, 42

(56) References Cited

U.S. PATENT DOCUMENTS

| | | | | | |
|---|---|---|---|---|---|
| 3,499,543 | A | * | 3/1970 | Updegrave | 212/288 |
| 3,690,387 | A | * | 9/1972 | Dixon | 173/193 |
| 4,093,091 | A | * | 6/1978 | Gregg et al. | 414/642 |
| 4,100,843 | A | | 7/1978 | Dietrich et al. | |
| 4,100,973 | A | | 7/1978 | Freudenthal | |
| 4,106,368 | A | | 8/1978 | Ivey | |
| 4,236,408 | A | | 12/1980 | Corry | |
| 4,456,093 | A | * | 6/1984 | Finley et al. | 182/2.2 |
| 4,532,595 | A | * | 7/1985 | Wilhelm | 701/124 |
| 4,752,012 | A | | 6/1988 | Juergens | |
| 5,160,055 | A | * | 11/1992 | Gray | 212/278 |
| 5,163,570 | A | | 11/1992 | Mundis et al. | |
| 5,557,526 | A | * | 9/1996 | Anderson | 701/50 |
| 6,019,441 | A | | 2/2000 | Lloyd et al. | |
| 6,173,573 | B1 | * | 1/2001 | Kamada | 60/422 |
| 6,202,013 | B1 | * | 3/2001 | Anderson et al. | 701/50 |
| RE37,661 | E | * | 4/2002 | Raunisto | 405/232 |

OTHER PUBLICATIONS

Hoffelmeyer et al, Side Load Detection and Protection System for Rotatable Equipment, Nov. 7, 2002, US 2002/0165628 A1.*

* cited by examiner

*Primary Examiner*—Scott A. Smith
*Assistant Examiner*—Brian Nash
(74) *Attorney, Agent, or Firm*—Hovey Williams LLP

(57) ABSTRACT

A rotational float system (44) that is meant to be used with existing side load protection systems and that may be selectively operated to permit a digger derrick rotation motor (20) or other rotatable equipment to freely rotate toward a side load to ease operation of and prevent damage to the digger derrick (10) and to assist in the correct installation of screw anchors. The rotational float system (44) includes valve structure (46) interposed between the ports (32, 34) of a hydraulic rotation motor (20) and a control mechanism (48) for selectively opening and closing the valve structure (46). The valve structure (46) is normally biased to a closed position and the control mechanism (48) is normally open. When the control mechanism (48) is operated, it opens the valve structure (46) to connect the ports (32, 34) of the rotation motor (20) to one another. This allows the pressure of the hydraulic fluid present at each of the ports (32, 34) to equalize so that the rotation motor (20) may float or rotate toward any external side loads.

10 Claims, 2 Drawing Sheets

ROTATIONAL FLOAT FOR ROTATING EQUIPMENT

BACKGROUND OF THE INVENTION

1. Field of the Invention

The present invention relates to rotatable equipment such as digger derricks. In particular, the invention relates to a rotational float system that may be selectively operated to permit a digger derrick boom to freely rotate toward a side load to simplify operation of and prevent damage to the digger derrick.

2. Description of the Prior Art

Digger derricks, cranes, and other types of rotating equipment are commonly used to perform many different jobs, including digging holes for utility poles and installing screw anchors for supporting the poles. Digger derricks are typically mounted to mobile utility vehicles and include a rotating turntable from which a boom extends. The boom may be raised, lowered, extended, and retracted to position its outboard end in various locations to perform digging or hoisting operations. Digger and auger assemblies may be coupled with the outer end of the boom for digging holes for utility poles and for installing screw anchors. Once installed, anchors are typically connected to guy wires to stabilize the top portion of a pole in a particular direction and therefore are preferably installed into the ground at some angle relative to vertical.

Digger derricks and other rotating equipment are often subjected to excessive and undesirable side loading. Side loading can be applied to a digger derrick boom when, for example, a winch attached to the boom is used to pull a heavy load in from the side of the boom. Side loading also often occurs when an auger-type digger coupled with the boom "corkscrews" into the ground due to the application of excessive pressure in driving the auger or when anchors are improperly installed. Excessive side loading can cause damage or destruction of the digger derrick's boom, turntable, and rotation drive mechanism. Improper installation of an anchor can also significantly reduce its pull-out strength.

Special care must be taken when installing screw anchors to avoid or minimize such side loading. When a screw anchor is to be installed directly behind a truck to which a digger derrick is mounted (so that the truck is in-line with the direction of the anchor), it is necessary for the digger operator to monitor and control at least three functions to ensure that the boom generally follows the path of the anchor. Specifically, the operator must simultaneously operate the digger motor, lower the boom, and retract the boom as the anchor is being driven into the ground. If an anchor is to be installed on either side of the truck, as is common with the majority of roadside pole installations, it is also necessary for the digger operator to rotate the turntable and the boom toward the anchor as the anchor enters the ground to correctly follow the path of the anchor. Those familiar with the operation of digger derricks will appreciate that simultaneously monitoring all of these movements requires a great deal of skill and training. If an operator forgets or otherwise fails to correctly follow the path of an anchor into the ground by manipulating the digging, boom extending/retracting, boom lowering/raising, and rotating functions, the anchor will tend to pull the boom to one side, exerting considerable side loading on the derrick and/or reducing the pull-out strength of the anchor.

Systems have been developed for protecting digger derricks and other rotating equipment against excessive side loads. U.S. Pat. No. 4,100,973 (the '973 patent), hereby incorporated into the present application by reference, discloses a side load protection system that attempts to sense undesired side load levels and respond with appropriate action when pre-established limits have been exceeded. The system uses relief valves that open when pressure increases beyond a desired level in a hydraulic motor to allow the boom driven by the motor to slip or rotate toward the external load, thereby reducing the torque of the side load. Other side load protection systems are being developed that shut down certain digger derrick operations once side load limits have been reached.

Although generally effective, existing side load protection systems are subject to misuse. For example, operators who are aware of side load protection systems may intentionally neglect to rotate a digger derrick's boom to follow an anchor into the ground, knowing that the side load protection system will permit the turntable and boom to slip or rotate toward the side load once an excessive amount of side load has been exerted on the boom. This practice should be discouraged because existing side load protection systems require application of a high degree of side loading before they are activated. Such side load protection systems therefore are intended to provide protection from occasional high side loads, not repeated side loads resulting from everyday operation such as the installation of screw anchors. If an operator routinely relies on a side load protection system during normal operation of a digger derrick, the cumulative effect of the side loading that occurs before the side load protection system is engaged can significantly damage the digger derrick and reduce the holding power of any installed screw anchors.

SUMMARY OF THE INVENTION

The present invention solves the above-described problems and provides a distinct advance in the art of side load protection systems for digger derricks and other rotating equipment. More particularly, the present invention provides a rotational float system that is designed for use with existing side load protection systems and that may be selectively operated to permit a digger derrick rotation motor or other rotatable equipment to freely rotate toward a side load to ease operation of and prevent damage to the digger derrick.

The rotational float system of the present invention broadly includes valve structure interposed between the ports of a hydraulic rotation motor and a control mechanism for selectively opening and closing the valve structure. The valve structure is normally biased to a closed position and the control mechanism is normally open. When the control mechanism is operated, it opens the valve structure to connect the ports of the rotation motor to one another. This allows the pressure of the hydraulic fluid present at each of the ports to equalize so that the rotation motor may float or rotate toward any external side loads.

The rotational float system of the present invention may be selectively activated by an operator during normal operations of a digger derrick such as when a screw anchor is being installed. Once the bite of an anchor has been established, the operator may simply activate the control mechanism to open the valve structure and place the rotation motor in a float state. As the anchor travels further into the ground, it will exert a side load on the boom that will create a pressure differential between the two ports of the rotation motor. When activated, the rotational float system allows this pressure differential to equalize, causing the boom and turntable to rotate toward the anchor. This alleviates the side load and thus relieves the operator from the necessity of monitoring and controlling the rotation of the boom and turntable so the operator may concentrate on monitoring other necessary functions of the digger derrick.

These and other important aspects of the present invention are described more fully in the detailed description below.

BRIEF DESCRIPTION OF THE DRAWING FIGURES

A preferred embodiment of the present invention is described in detail below with reference to the attached drawing figures, wherein.

Figure 2:
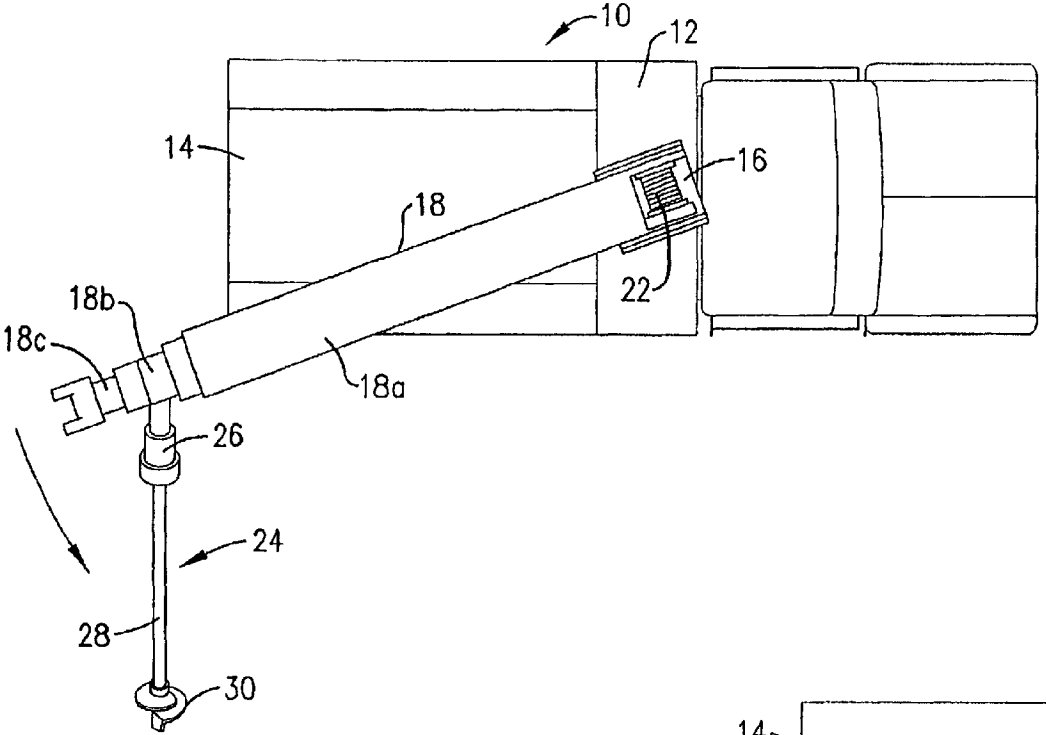
FIG. 2 is a schematic top plan view of the digger derrick shown with its boom positioned to the side of the truck to which it is mounted.

The drawing figures do not limit the present invention to the specific embodiments disclosed and described herein. The drawings are not necessarily to scale; emphasis instead being placed upon clearly illustrating the principles of the invention.

DETAILED DESCRIPTION OF THE PREFERRED EMBODIMENTS

Figure 1:
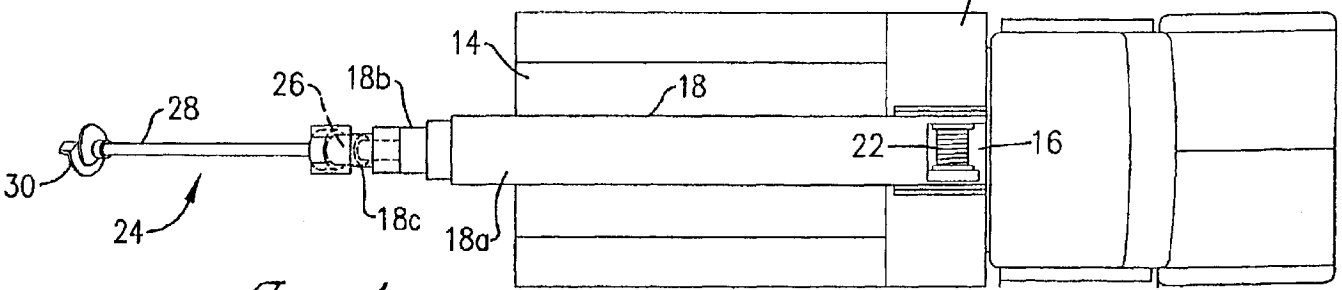
FIG. 1 is a schematic top plan view illustrating a conventional digger derrick which may be equipped with the invention described herein and which is shown with its boom positioned in-line with the truck to which it is mounted.

Turning now to the drawing figures, and particularly FIGS. 1 and 2, a conventional truck-mounted digger derrick 10 of the type with which the present invention is adapted for use is illustrated. The digger derrick 10 broadly includes a frame 12 mounted on a truck bed 14 that rotatably supports a turntable 16. An elongated boom 18 extends outwardly from the turntable 16 and is operable to rotate with the turntable 16.

The turntable 16 and the boom 18 are rotatably driven by a hydraulic rotation motor 20 (FIG. 3) mounted to the turntable 16. The rotation motor 20 delivers rotational force to the turntable 16 through conventional drive linkage. The boom 18 may be pivoted up and down relative to the turntable 16 by a conventional hydraulic cylinder system and includes a plurality of sections 18*a*, 18*b*, 18*c* that may extend and retract relative to one another in a telescopic fashion to vary the overall length of the boom 18. A hydraulically-powered winch 22 may be coupled with the turntable 16 and/or the boom 18.

When the digger derrick 10 is to be used to dig holes for utility poles or to install earth or screw anchors for supporting the poles, a driving tool 24 may be mounted to the intermediate section 18*b* of the boom. The driving tool 24 includes a digger power unit 26 that rotates a shaft 28 for turning a conventional earth auger (not shown) or a screw anchor 30.

Figure 3:
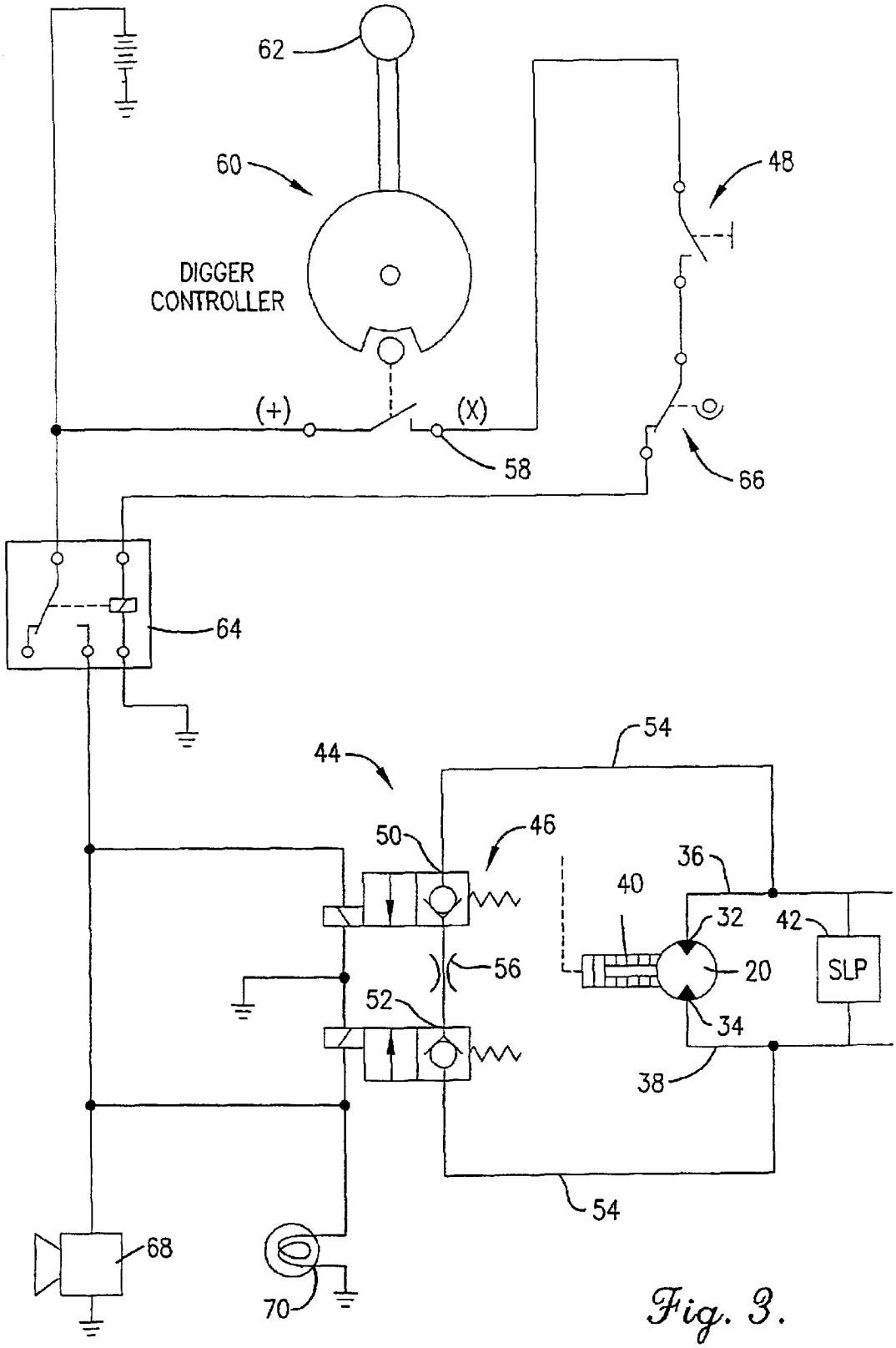
FIG. 3 is a schematic diagram of a rotational float system constructed in accordance with a preferred embodiment of the present invention shown coupled with a portion of a hydraulic system of the digger derrick illustrated in FIGS. 1 and 2.

FIG. 3 illustrates schematically portions of the hydraulic system which controls operation of the rotation motor 20. The hydraulics for operating other portions of the digger derrick 10, including the systems for raising, lowering, extending and retracting the boom 18 are eliminated from the schematic of FIG. 3 for purposes of simplicity.

As illustrated, the rotation motor 20 includes a pair of first and second hydraulic ports 32, 34 for receiving and discharging a pressurized media such as hydraulic fluid or oil from conventional hydraulic lines 36, 38 that receive hydraulic fluid from a source thereof. The digger derrick 10 is also preferably equipped with a hydraulically-released brake 40 that, when engaged, prevents the rotation motor 20 and drive linkage coupled thereto from being driven either forwardly or backwardly to prevent rotational movement of the turntable 16 and the boom 18. The brake 40 is automatically released whenever the rotation motor 20 and/or digger power unit 26 is operated. Thus, when the boom 18 is being rotated and/or when the digger power unit 26 is being operated, any side loads applied to the boom 18 are held hydraulically by the rotation motor 20. The hydraulically-operated brake 40 and its operation are described in more detail in the '973 patent referenced above.

The digger derrick 10 is also preferably equipped with a side load protection system 42 that reduces or prevents damage to the boom 18 and other portions of the digger derrick 10 when an undesired side load is applied to the boom 18. One such side load protection system is disclosed in the '973 patent referenced above and another is disclosed in pending patent application entitled "A Side Load Detection and Protection System for Rotatable Equipment", Ser. No. 09/846,977, filed May 1, 2001, which is now U.S. Pat. No. 6,735,486 entitled "Side Load Detection and Protection System for Rotatable Equipment", also hereby incorporated into the present application by reference.

As discussed previously, the side load protection system 42 is intended to provide protection from occasional high side loads, but should not be relied upon to relieve repeated side loads resulting from every day installation of screw anchors 30. If an operator routinely relies on the side load protection system 42 when installing screw anchors 30 and performing other normal functions, the cumulative effect of the side loading that occurs before the side load protection system 42 is engaged can significantly damage the digger derrick 10 over time and reduce the holding power of installed screw anchors 30.

The present invention provides a rotational float system broadly referred to by the numeral 44 in FIG. 3 which is designed to complement the side load protection system 42 by providing relief from side loads caused by everyday operation of the digger derrick 10. FIG. 3 illustrates a preferred embodiment of the rotational float system 44, which broadly includes valve structure 46 interposed in the hydraulics of the rotation motor 20 and a control mechanism 48 operatively coupled with the valve structure 46 for controlling operation thereof.

The valve structure 46 is preferably interposed between the hydraulic lines 36, 38 connected to the first and second ports 32, 34 of the rotation motor 20 but can be positioned anywhere as long as it is in fluid communication with both ports 32, 34 of the rotation motor 20. The valve structure 46 is normally closed so that the hydraulic lines 36, 38 are substantially isolated from one another and can be selectively switched to an open position to place the hydraulic lines 36, 38 in fluid communication with one another. When the valve structure 46 is switched to this open position, hydraulic fluid may flow freely between the two hydraulic lines 36, 38, thus equalizing the hydraulic pressure between the first and second ports 32, 34 of the rotation motor 20. This places the rotation motor 20 in a "float" condition or state and enables the turntable 16 and boom 18 driven by the rotation motor 20 to freely float or rotate toward a side load.

The valve structure 46 preferably comprises a pair of back-to-back poppet-type solenoid valves 50, 52 connected to the hydraulic lines 36, 38 by conventional hydraulic circuitry 54. The two poppet-type solenoid valves 50, 52 may be replaced with any type of blocking valve that prevents flow through line 54, but bidirectional blocking is best achieved by using the preferred arrangement of two back-to-back poppet-type solenoid valves 50, 52 as illustrated.

The valve structure 46 also preferably includes an orifice or other flow control 56 that regulates the rate at which hydraulic fluid may flow therethrough to control the rate at which pressure is equalized between the two ports 32, 34 of the rotation motor 20. The orifice 56 may be positioned anywhere in the hydraulic circuitry 54, for example, between the two solenoid valves 50, 52. The orifice 56 slows the rotation speed of the turntable 16 and boom 18 to an acceptable level when the valve structure 46 is switched to its open position and the boom 18 is subjected to a side load. Those skilled in the operation of digger derricks will appreciate that regulating the rotation speed of the turntable 16 and boom 18 is necessary, especially when the digger derrick 10 is on a slope, to prevent unexpected boom movement. The size of the orifice 56 may be selected to allow any rate of hydraulic fluid flow therethrough and may even be replaced with a variable-type flow mechanism so that the rotation speed of the turntable 16 and boom 18 may be selectively adjusted.

The control mechanism 48 is electrically connected between the valve structure 46 and a terminal 58 on a digger control panel 60 positioned within reach of an operator of the digger derrick 10. The control mechanism 48 allows an operator to selectively switch the valve structure 46 from its normally closed position to an open position to place the rotation motor 20 in a float state. The terminal 58 is only powered when a control lever or joystick 62 on the digger control panel 60 is displaced from its center position to power the digger power unit 26. This prevents the rotational float system 44 from placing the rotation motor 20 in a float state unless the digger power unit 26 is operated.

The control mechanism 48 is preferably electrically isolated from the valve structure 46 by a relay 64. The relay 64 permits the control mechanism 48 to be powered by a low-amp signaling line and the valve structure 46 to be powered by a higher-amp line.

The control mechanism 48 may be any type of switch or controller, but is preferably a push-button switch positioned within reach of the digger derrick's digger control lever or joystick 62. The control mechanism 48 may be, for example, a push button switch located on the tip of the digger joystick 62 so that it can be easily actuated by an operator's thumb while the operator manipulates the joystick 62 to control the digging operation of the derrick 10. The control mechanism 48 is preferably normally open, momentarily closed so that it must be held in its closed position to switch the valve structure 46 to its open, float state. As soon as the control mechanism 48 is released, it opens and thereby causes the valve structure 46 to close.

The rotational float system 44 also preferably includes a tilt switch 66 connected in series with the control mechanism 48. The tilt switch 66 is normally closed and opens to disable the control mechanism 48 whenever the digger derrick 10 is positioned on a slope equal to or exceeding a predetermined amount. For example, the tilt switch 66 may be set to open whenever the digger derrick 10 is on a slope of 5° or more. This prevents the operator from placing the rotation motor 20 in a float condition whenever the digger derrick 10 is on a slope for safety purposes. The tilt switch 66 is preferably an omni-directional, pendulum-type switch. The slope threshold for the switch may be selected to complement the size of the orifice 56 so as to obtain an acceptable boom rotation speed for a given slope threshold. For example, if the orifice 56 is sized to provide a very slow boom 18 and turntable 16 rotation speed, the slope threshold of the tilt switch 66 may be greater, but if the orifice 56 is sized to allow faster rotation of the boom 18 and turntable 16, the slope threshold of the tilt switch 66 should be lower.

The rotational float system 44 also preferably includes an alarm or notification system for alerting the operator and any other nearby persons when the boom 18 and turntable 16 are placed into a float state. The alarm system preferably includes an audible alarm 68 and a visible alarm 70 that may be on or near the digger derrick 10 and that are both activated whenever the rotational float system 44 is enabled.

Operation

The digger derrick 10 may be operated in a conventional manner to perform various hoisting and digging operations such as digging holes for utility poles and installing screw anchors 30 for supporting utility poles. During normal operation of the digger derrick 10, the boom 18 may be subjected to undesirable side loading. The rotational float system 44 may be activated when operating the dig function to place the rotation motor 20 and the boom 18 and turntable 16 coupled therewith in a rotational float state to rotate toward and relieve such side loading.

For example, FIG. 1 illustrates the installation of a screw anchor 30 directly behind, or in-line, with the digger derrick 10. For these types of screw anchor 30 installations, the operator must simultaneously monitor and control the operations of the digging power unit 26, the hydraulic systems controlling lowering and raising of the boom 18, and the hydraulic systems controlling extending and retracting of the boom 18 as the screw anchor 30 bites into the ground so as to follow the path of the screw anchor 30. If the operator fails to do so, the pull-out strength of the anchor 30 may be compromised and the boom and the driving tool may be damaged. However, for installation applications as illustrated in FIG. 1, the operator does not have to monitor and control rotation of the boom 18 and turntable 16 because the anchor 30 is being installed behind, or in-line with the digger derrick 10. Thus, no rotational side loads are placed on the turntable 16 and boom 18 as a result of the anchor 30 entering the ground.

FIG. 2 illustrates the more common installation of a screw anchor 30 to the side of the digger derrick 10. This type of installation is more common because utility poles and anchors 30 for supporting the poles are commonly installed along the sides of roads, and the digger derrick 10 cannot be positioned directly in-line with the hole to be dug or the anchor 30 to be installed. For these types of screw anchor 30 installations, the operator must simultaneously monitor and control all of the operations described in the previous paragraph and additionally must rotate the turntable 16 and boom 18 toward the anchor 30 as the anchor 30 is driven into the ground so as to follow the path of the anchor 30. If the operator fails to do so, the anchor 30 will tend to pull the boom 18 toward it, exerting considerable side loading on the digger derrick 10.

Side loading will create a differential pressure between the two ports 32, 34 of the rotation motor 20. While the digger is being operated, the brake 40 on the rotation motor 20 will be released, causing any rotational side load to be held hydraulically by the rotation motor 20. If an excessive side load that equals or exceeds the threshold of the side load protection system 42 is developed, the side load protection system 42 will either alleviate the side load by allowing the boom 18 and turntable 16 to rotate toward the load or will disable all functions of the digger derrick 10 that could be causing the side load. However, as described above, by the time the side load protection system 42 is enabled, the side load may have already caused damaged to the digger derrick 10 and/or reduced the pullout strength of an installed anchor 30, especially if the side load protection system 42 is repeatedly enabled during routine operation of the digger derrick 10.

The rotational float system 44 of the present invention allows an operator of the digger derrick 10 to selectively relieve side loads caused by normal operation of the digger derrick 10 before the side load protection system 42 is activated. For example, the rotational float system 44 may be selectively activated by an operator any time a screw anchor 30 is being installed. Once the bite of an anchor 30 has been established, the operator may simply activate the control mechanism 48 to open the valve structure 46 and place the rotation motor 20 in a float state. As the anchor 30 travels further into the ground, it will exert a side load on the boom 18 that will attempt to create a pressure differential between the two ports 32, 34 of the rotation motor 20. The activated rotational float system 44 allows this pressure differential to equalize, causing the boom 18 and turntable 16 to rotate toward the anchor 30. This alleviates the side load, relieving the operator from the necessity of monitoring and controlling the rotation of the boom 18 and turntable 16 and thus allowing the operator to concentrate on other necessary functions of the digger derrick 10.

In another embodiment of the present invention, the above-described "float" condition can be achieved using existing holding valves for the rotation motor 20. Holding valves are used to prevent the rotation motor 20 from free-wheeling if hydraulic fluid lines leading to the motor break. Typically, one holding valve is interposed in the media line 36 connected to the first port 32 of the rotation motor 20 and a second holding valve is coupled with the media line 38 connected to the second port 34 of the rotation motor 20. The holding valves in turn are connected to a directional valve that serves as the main control valve for controlling rotation of the motor 20. The center position of this directional valve connects the fluid lines leading to the holding valves. Thus, when the directional valve is in its center position, one or both of the holding valves may be opened to equalize the pressure between the first and second media lines 36, 38 and the pressure between the first and second ports 32, 34 of the rotation motor 20.

Although the invention has been described with reference to the preferred embodiment illustrated in the attached drawing figures, it is noted that equivalents may be employed and substitutions made herein without departing from the scope of the invention as recited in the claims. For example, although the present invention is especially useful when equipped with a digger derrick 10, it may be used in connection with any machine or system that utilizes a rotation motor and that is subject to undesirable side loads.

Having thus described the preferred embodiment of the invention, what is claimed as new and desired to be protected by Letters Patent includes the following:

1. In a rotation motor system including a rotation motor having first and second ports, first and second media lines respectively operably coupled with the first and second ports for receipt and discharge of pressurized media by the motor for operation thereof, and a first, pressure-responsive control system operably coupled with the motor for protecting the motor when the motor experiences a pressure exceeding a predetermined level, the improvement, which comprises a second, pressure-independent control system, comprising:

a valve interposed between the first and second media lines and shiftable between a closed position wherein the first and second media lines are substantially isolated from one another and a pressure differential exists between the first and second media lines, and an open position wherein the first and second media lines are in communication with one another and the pressure differential between the first and second lines is reduced as compared with the pressure differential when the valve is in the closed position; and a manually controlled control mechanism coupled with the valve and operable to shift the valve from the closed to the open position independently of the pressure-responsive operation of the first control system and of the pressure differential between the first and second media lines.

2. The rotation motor system as set forth in claim 1, the valve comprising a pair of poppet-type valves in fluid communication with one another between the first and second media lines.

3. The rotation motor system as set forth in claim 1, the valve comprising a blocking valve interposed between the first and second media lines.

4. The rotation motor system as set forth in claim 1, the control mechanism comprising a switch for electrically controlling switching of the valve between the closed and the open positions.

5. The rotation motor system as set forth in claim 1, the pressurized media comprising hydraulic fluid.

6. The rotation motor system as set forth in claim 1, further including a tilt switch operatively coupled with the control mechanism for preventing the control mechanism from switching the valve to the open position.

7. The rotation motor system as set forth in claim 6, further including an indicator operatively coupled with the control mechanism for indicating when the control mechanism has switched the valve to the open position.

8. The rotation motor system as set forth in claim 7, the indicator including an audible alarm or a visible alarm.

9. The rotation motor system as set forth in claim 1, further including an electrical relay interposed between the control mechanism and the valve.

10. The rotation motor system as set forth in claim 1, further including a flow control device positioned in-line with the valve for controlling a rate at which the valve allows equalization of pressure between the first and second ports of the rotation motor when the valve is switched to the open position.

* * * * *